US006109181A

United States Patent [19]

Kamoda

[11] Patent Number: 6,109,181

[45] **Date of Patent: *Aug. 29, 2000**

[54] INKING DEVICE FOR PRINTING MACHINE

[75] Inventor: Hiroyoshi Kamoda, Chiba, Japan

[73] Assignee: Komori Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/128,480

[22] Filed: Aug. 4, 1998

[30] Foreign Application Priority Data

Aug. 8, 1997 [JP] Japan ..... 9-214369

[51] Int. Cl.[7] ..... B41F 31/00; B41L 47/14

[52] U.S. Cl. ..... 101/477; 101/349.1; 101/351.03; 101/352.04

[58] Field of Search ..... 101/352.01, 352.02, 101/352.03, 352.04, 349.1, 351.1, 351.2, 351.3, 247, 477, 479

[56] References Cited

U.S. PATENT DOCUMENTS

| | | | |
|---|---|---|---|
| 1,524,816 | 2/1925 | Dalby | 101/352.04 |
| 2,004,801 | 6/1935 | Sheppard . | |
| 2,128,360 | 8/1938 | Harrold et al. . | |
| 2,564,590 | 8/1951 | Aberle . | |
| 3,020,841 | 2/1962 | Thut et al. . | |
| 4,625,642 | 12/1986 | Despot et al. | 101/352 |
| 5,230,284 | 7/1993 | Kelm | 101/247 |

FOREIGN PATENT DOCUMENTS

| | | |
|---|---|---|
| 0275025A2 | 7/1988 | European Pat. Off. . |
| 0437230A2 | 7/1991 | European Pat. Off. . |
| 1949092 | 4/1970 | Germany . |
| 63-172651 | 7/1988 | Japan . |
| 734670Y2 | 8/1995 | Japan . |

*Primary Examiner*—Kimberly Asher

[57] ABSTRACT

The present invention is to provide an inking device for a printing machine, which enables a work for replacing a plate cylinder to be carried out easily without removing a form roller or readjusting a nip pressure. Over a bearing 10 of the first swing roller 9*a* are supported a roller supporting lever 35 supporting rotatably the first form roller 13*a* and a roller attaching/detaching lever 45 linked with link mechanisms 49,47 and 48 each mounted on a machine frame 1, a compression coil spring 63 is mounted in each lever via a guide rod for biasing the first form roller 13*a* against a plate cylinder 4, and the first form roller 13*a* is able to be moved to a retreat position separated from a running position into the axial direction of the plate cylinder by a prescribed distance via both the levers 35 and 45.

16 Claims, 7 Drawing Sheets

INKING DEVICE FOR PRINTING MACHINE

BACKGROUND OF THE INVENTION (1) Field of the Invention

The present invention relates to an inking device for a printing machine, which a replacing work of a plate cylinder therein is made easier.

(2) Description of the Related Art

Heretofore, an inking device mounted on a printing machine, such as a rotary printing machine, is provided with an ink and a number of rollers. The ink, reserved in the ink fountain, is taken up by rotating the roller to adhere the ink to the surface of the roller in the state of an ink film. Subsequently, this ink film is uniformed and kneaded in various directions while transferred among a number of rollers, and then it is supplied to a plate surface on a plate cylinder by a form roller.

In such an inking device, there is a fear that a contact pressure between the form roller and the print surface, viz. a nip pressure is varied owing to the change in the diameter of the form roller by the thermal expansion and abrasion thereof, the finish state of the plate cylinder, and the like. Since the nip pressure largely influences the quality of prints, the nip pressure is adjusted in a printing preparation step or at the time of printing by providing the inking device with a nip pressure adjusting device. An example of this kind of nip pressure adjusting device is disclosed in Japanese Utility Model Publication No. 34670/1995 suggested by the applicant of the present invention.

Meanwhile, when an old number barrel is removed in order to replace the old number barrel (plate cylinder) with a new number barrel in a number printing machine, up to this time, a part (any form rollers etc. being situated in the direction of removing the number barrel to blockade the removal) of a plurality of form rollers that are rotatable is connect the plate cylinder had to be previously dismounted.

Accordingly, a man-hour for removing these rollers is increased, and moreover, it is required to adjust a nip pressure again, and hence it has caused a problem that a lot of hours and labor are necessary therefor.

An inking device presented by the applicant of the present invention is disclosed in Japanese Laid-Open Patent Publication No. SHO 63-172651. In this device, a plate cylinder etc. of which is able to be subjected to the maintenance service without a readjustment of a nip pressure by retracting a form roller largely from its operating position instead of removing.

This is, as illustrated in FIG. 7, under the condition that an ink supply unit 102 is dismounted, when a rubber barrel 100, pushing barrel 101, etc. are to be cleaned, and a spring 105 pushing a form roller 103 against a running-in roller 104 of the ink supply unit 102 is removed and the engagement between a claw 107 of a lever 106 and an engaging piece 108 of a frame is loosened, as shown by the imaginary lines in the figure. Thus, the form roller 103 and an ink holding roller 109 become shiftable largely along the periphery of a number cylinder 110 together with the lever 106, and thereby creating a space over the number cylinder 110 so that the cleaning work becomes easier.

However, in the above inking device, since it employs such a structure that the form roller 103, connected to the number cylinder 110 by the lever 105, is shifted along the periphery of the number cylinder 110 to retract from the operating position, there is a problem that the form roller 103, lever 106, etc. hinder the number cylinder 110 from being removed.

Accordingly, an object of the present invention is to provide an inking device for a printing machine, wherein a replacing work of a plate cylinder is easily practiced without dismounting a form roller or readjusting a nip pressure.

SUMMARY OF THE INVENTION

An inking device for a printing machine according to the present invention with the aim to solve the above problems is constituted as follows:

(1) An inking device for a printing machine detachably supporting a form roller to a plate cylinder, wherein the form roller is rotatably supported by a lever pivotally mounted on a machine frame so that the form roller can be moved to a running position where the form roller contacts the plate cylinder via the lever, a detachment position separated from the plate cylinder and a retreat position separated as much as a predetermined distance from the detachment position.

(2) The inking device for the printing machine according to the above-mentioned paragraph (1), wherein the lever is linked with a link mechanism supported by the machine frame so that the form roller can be moved to the retreat position by the operation of an operating portion via the link mechanism.

(3) The inking device for the printing machine according to the above-mentioned paragraph (2), wherein the lever comprises a first lever for rotatably supporting the form roller and a second lever coaxially supported with the first lever so as to be linked with the link mechanism, and a spring member for always pressing the form roller against the plate cylinder is disposed via a guide rod between the first lever and second lever.

(4) The inking device for the printing machine according to the above-mentioned paragraph (3), wherein the first lever and second lever are adjacently supported coaxially with oscillating roller which the form roller rotatably contacts.

(5) The inking device for the printing machine according to the above-mentioned paragraph (3), wherein the form roller is supported by the first lever via a holder, and the end portion of the holder is eccentrically supported by the first lever.

(6) The inking device for the printing machine according to the above-mentioned paragraph (2), wherein a cam follower contacting a plate cylinder follow-up cam is supported by the lever.

(7) The inking device for the printing machine according to the above-mentioned paragraph (6), wherein the cam follower is movably supported by the lever and provided with an adjusting means for adjusting a position of the cam follower.

(8) The inking device for the printing machine according to the above-mentioned paragraph (6), wherein another cam follower contacting a roller-lifting cam is supported by the lever.

According to a constitution of the present invention, the form roller can be to moved largely to the retreat position from a plate cylinder without removing the form roller and while keeping a set condition of a nip pressure etc. so as to make it easier to remove a plate cylinder.

Also, a mechanism for attaching/detaching a form roller by the second lever is easily parted from another mechanism for acting on the form roller etc. by the first lever without causing any trouble in both the mechanisms, and consequently the reliability of the unit is raised.

DETAILED DESCRIPTION OF THE PREFERRED EMBODIMENTS

Figure 1:
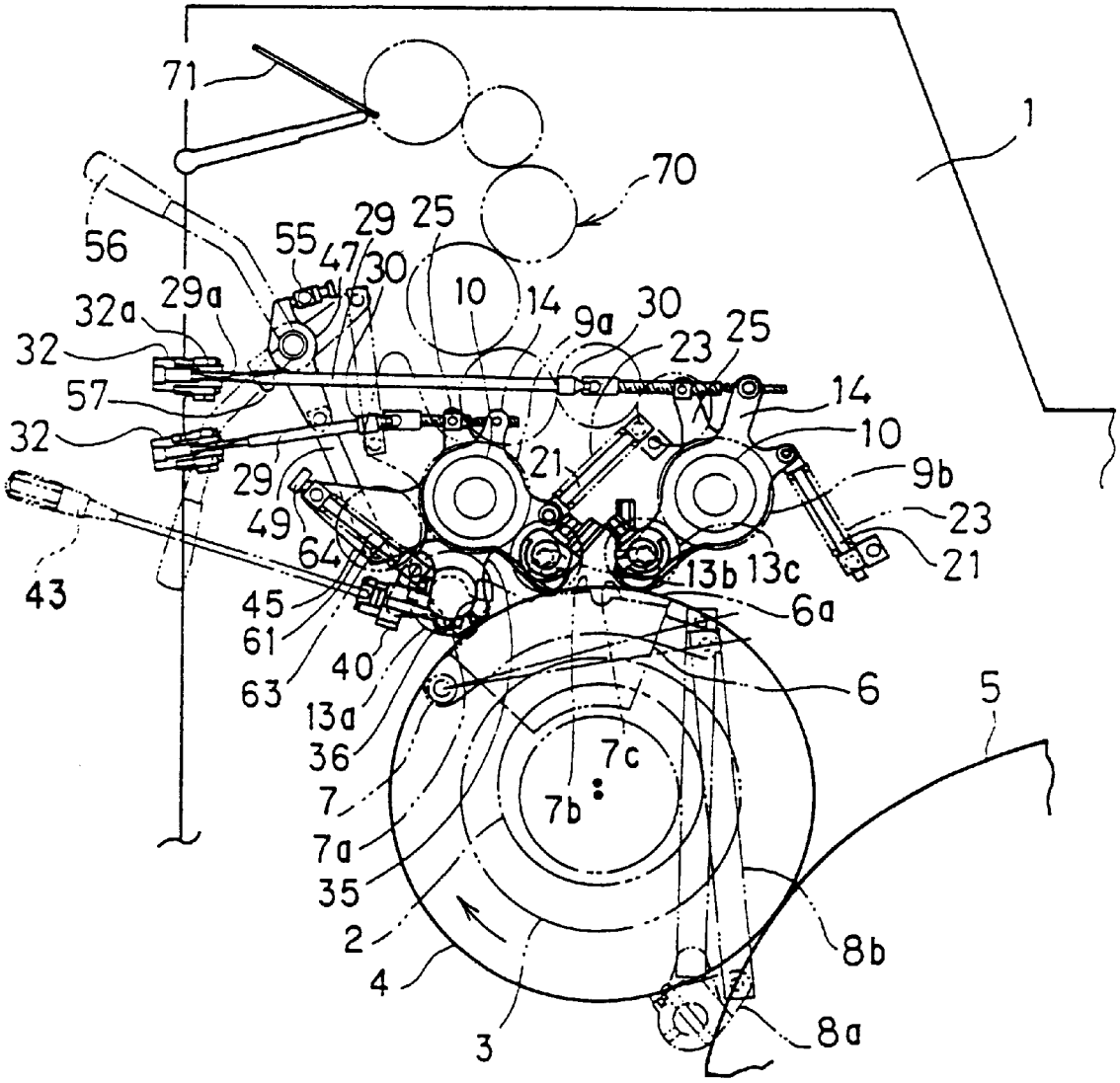
FIG. 1 shows a side view of a main part of an inking device relating to an embodiment of the present invention.
Figure 2:
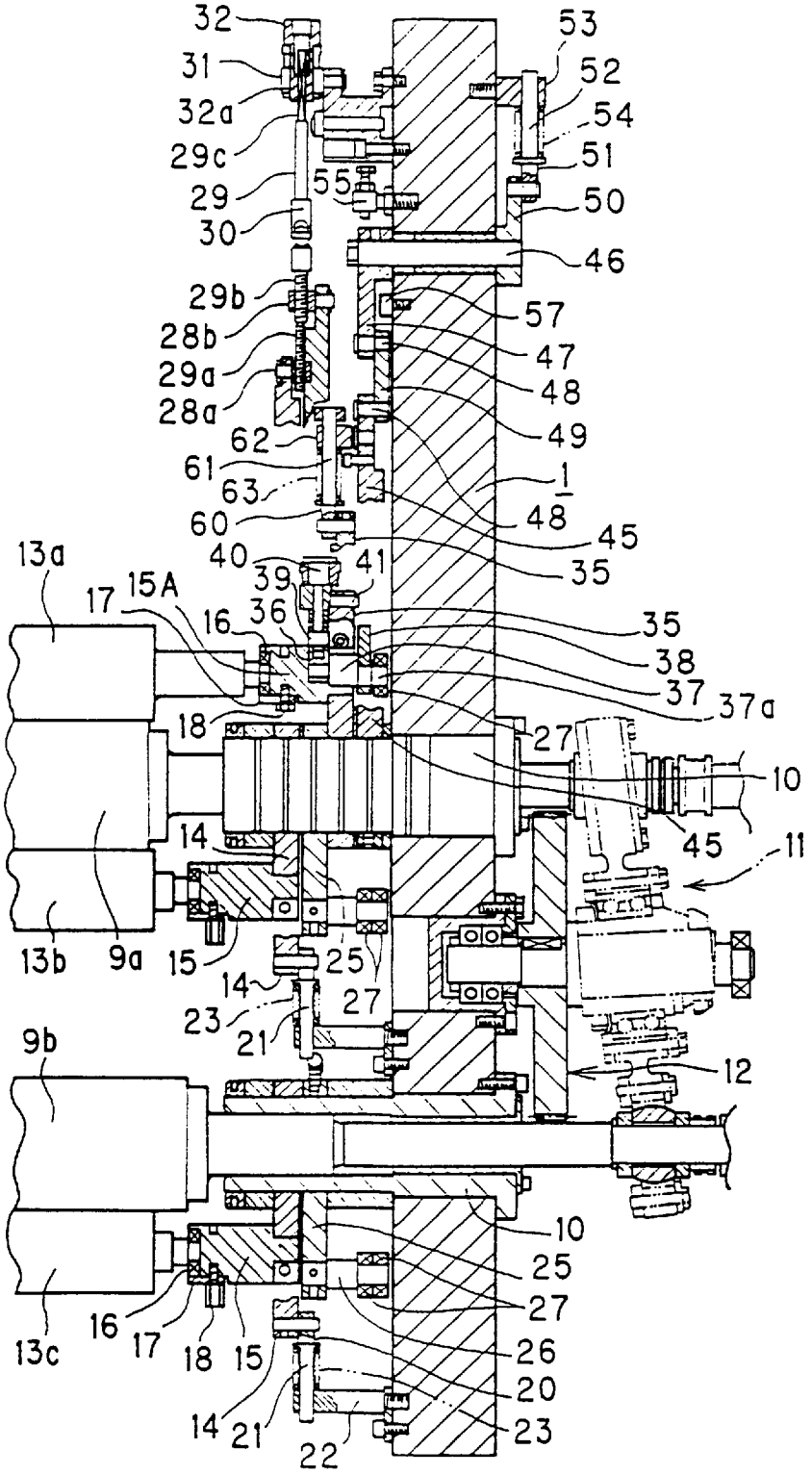
FIG. 2 shows a cross sectional plan view of the main part of the inking device relating to the embodiment of the present invention.
Figure 3:
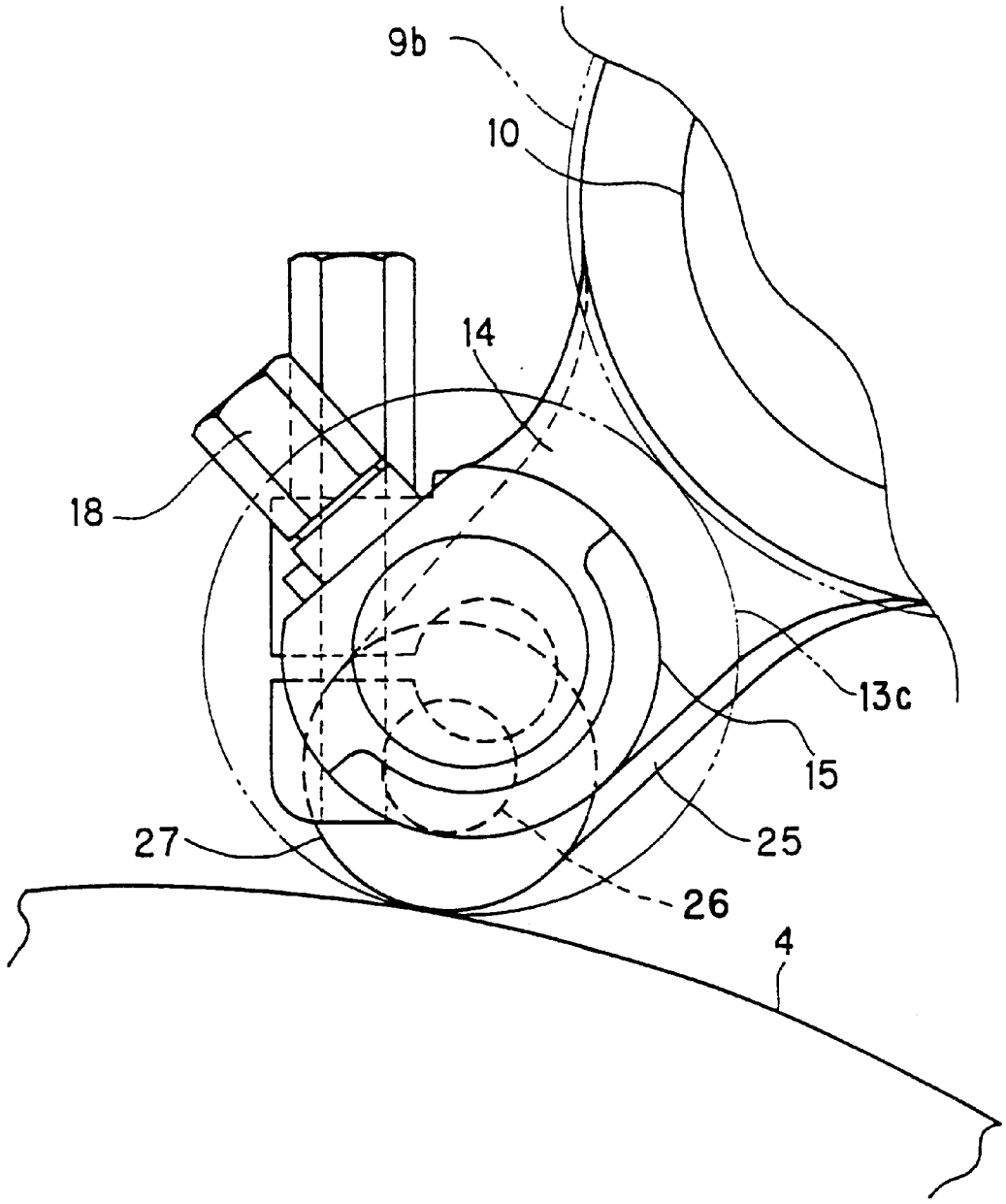
FIG. 3 shows an enlarged side view of the first form roller of the inking device relating to the embodiment of the present invention.
Figure 4:
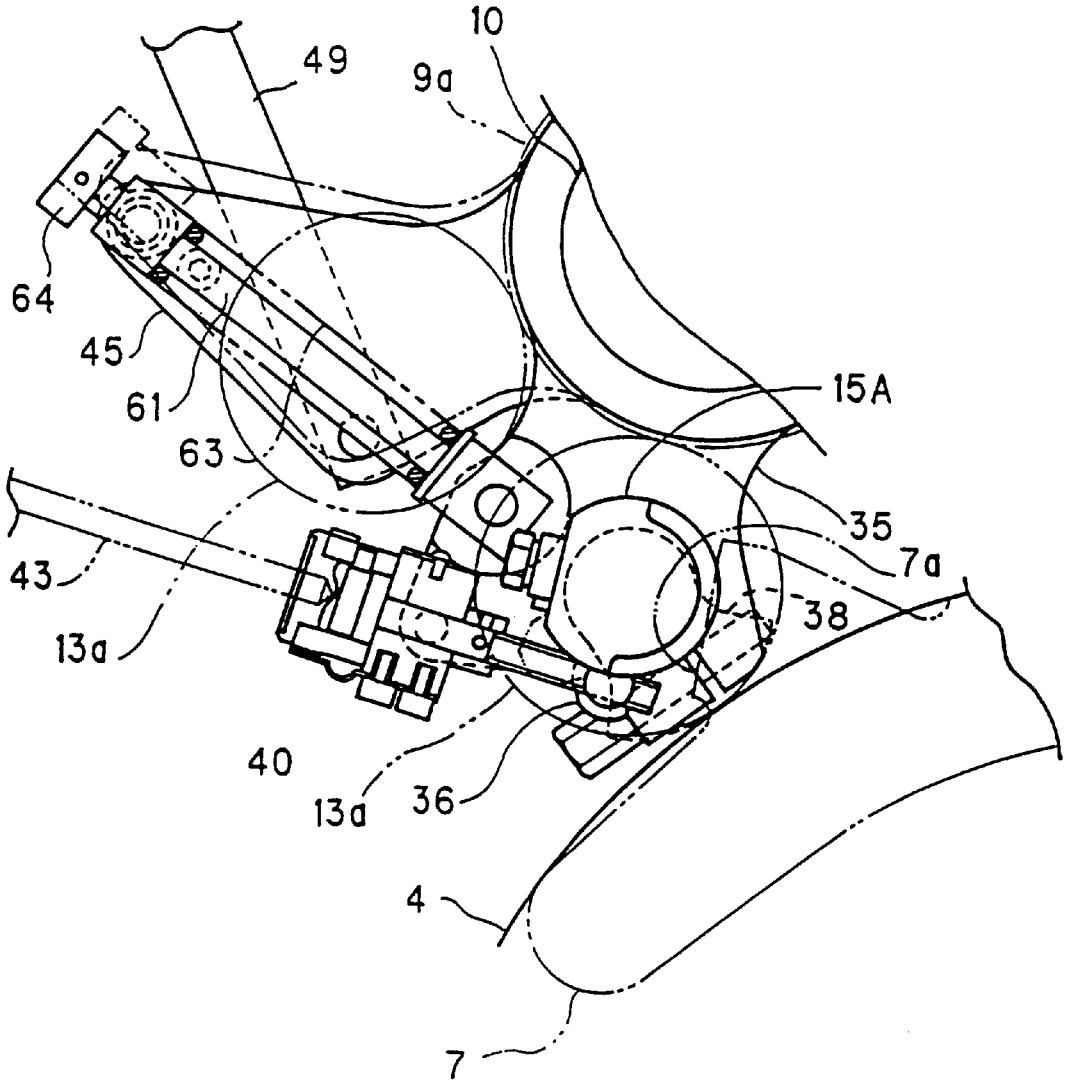
FIG. 4 shows an enlarged side view of the third form roller of the inking device relating to the embodiment of the present invention.
Figure 5:
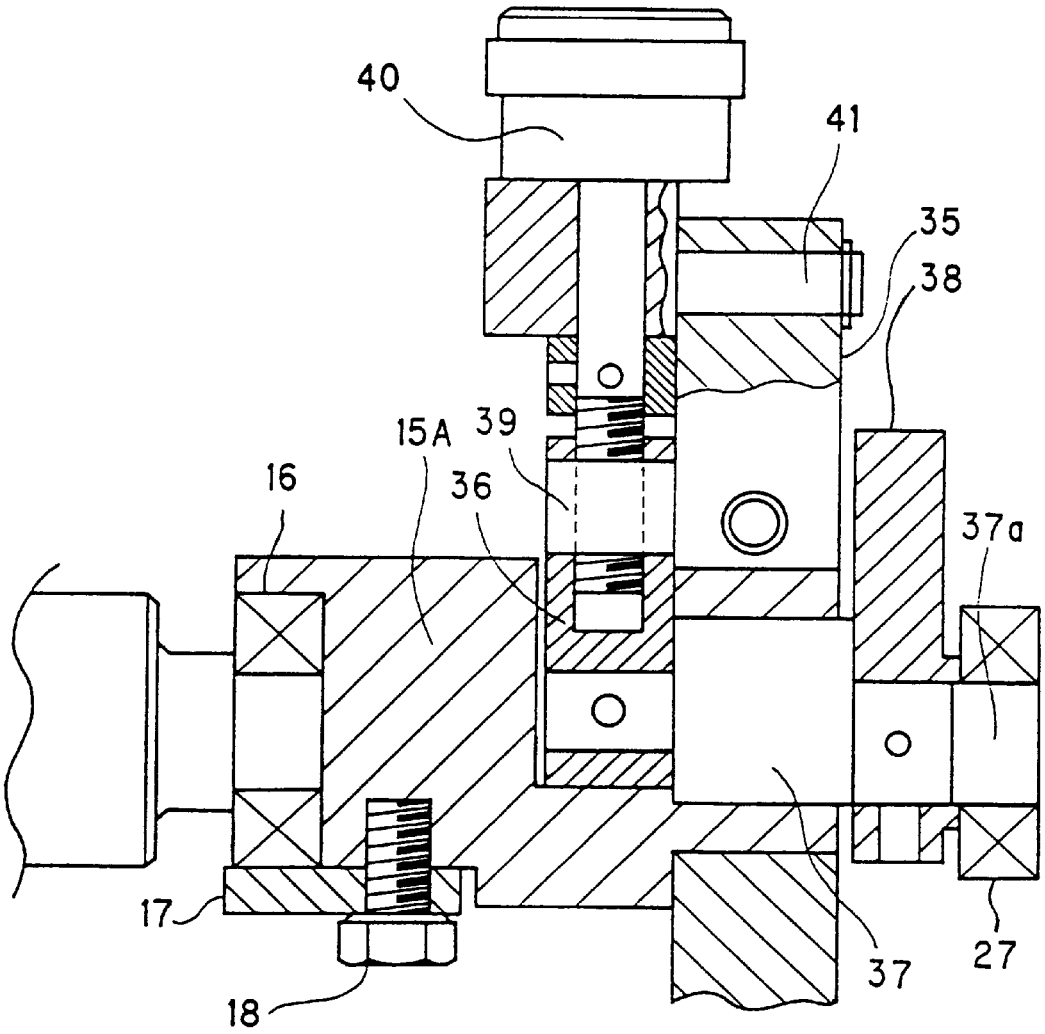
FIG. 5 shows an enlarged cross sectional plan view of the third form roller.
Figure 6:
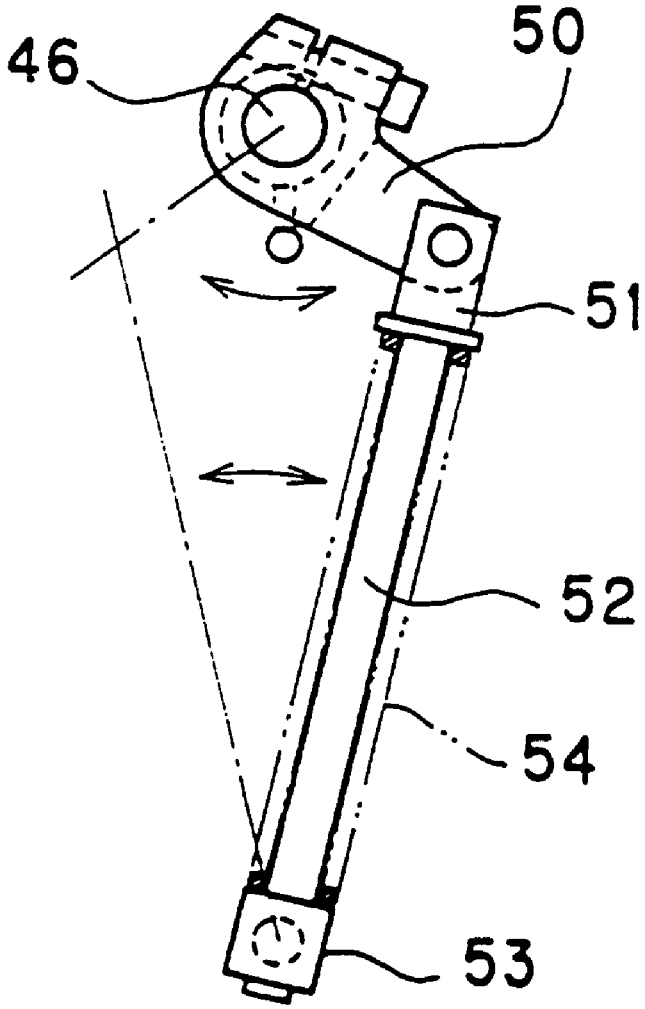
FIG. 6 shows a side view of a reverse driving portion.
Figure 7:
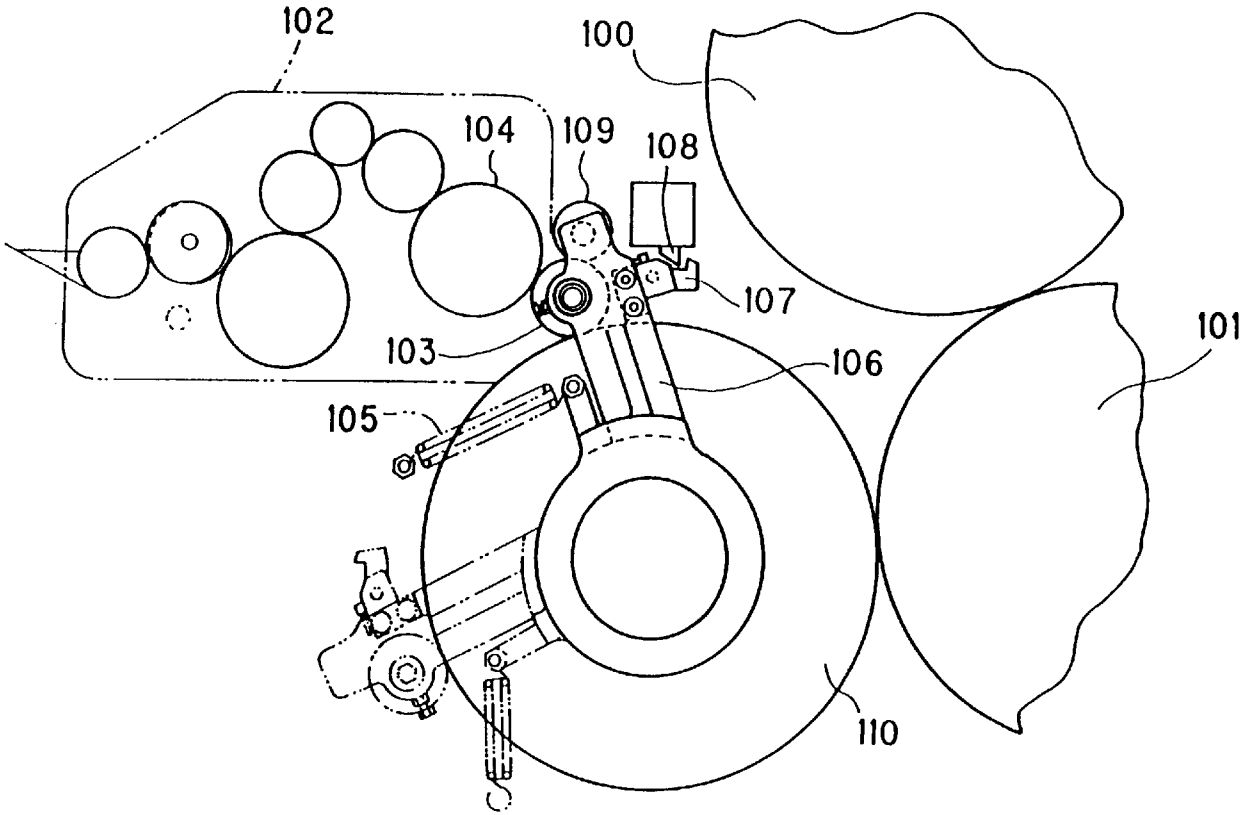
Fig.7 Related Art
FIG. 7 shows a side view of a conventional inking device.

FIG. 1 is a side view showing a main part of an inking device relating to an embodiment of the present invention, FIG. 2 is a cross sectional plan view showing the a main part of the inking device relating to the embodiment of the present invention, FIG. 3 is an enlarged side view showing the first form roller of an inking device relating to the embodiment of the present invention, FIG. 4 is an enlarged side view showing the third form roller of the inking device relating to the embodiment of the present invention, FIG. 5 is an enlarged cross sectional plan view showing the third form roller, and FIG. 6 is a side view showing a reverse driving portion.

As shown in FIGS. 1 and 2, a plate cylinder (a number barrel etc.) 4 is rotatably and axially supported by a couple of right-and-left frames via the first and second eccentric bearings 2 and 3 and a contact pressure between a plate cylinder 4 and pushing barrel 5 is adjusted by shifting a pair of the first right-and-left eccentric bearings 2, in such a situation, a twist adjustment is conducted by shifting either of the second right-and-left eccentric bearings 3.

A plate cylinder follow-up cam 6 is mounted on the second eccentric bearing 3 so that a circular cam surface 6*a* may be in conformity with the outer periphery of the plate cylinder 4, and a roller-lifting cam 7 (a cam adapted to attach/detach the first to third form rollers 13*a* to 13*c* that will be described later.), having three cam surfaces 7*a*, 7*b*, and 7*c*, is swingably supported by the frames 1 so as to be adjacent to the plate cylinder follow-up cam 6, so that the first to third form rollers 13*a* to 13*c* can be attached/detached to/from the plate cylinder 4 by driving means such as a lever 8*a*, a rod 8*b*, and an attaching/detaching cylinder (not shown).

Above the plate cylinder 4, both the axial ends of each of the first and second swing rollers 9*a* and 9*b* positioned in the end portion of the inking device are rotatably supported by the frames 1 via the bearings 10, and the swing rollers 9*a* and 9*b* are provided with a swinging mechanism 11 and each adapted to be reciprocated in the axial direction in the prescribed cycles while drivingly rotated by a driving means 12.

The above mentioned first and second form rollers 13*a* and 13*b* rotatably contact the first swing roller 9*a*, and similarly the third form roller 13*c* rotatably contacts the second swing roller 9*b*.

That is to say, as illustrated in FIG. 3, roller supporting levers 14 are rotatably mounted on the bearings 10 of the first and second swing rollers 9*a* and 9*b*, and the second and third form rollers 13*b* and 13*c* are each supported by one end side of the roller supporting levers 14 via holders 15 respectively. Bearings 16 to support the axial ends of the first and second form rollers 13*a* and 13*b* are fixed to one ends of the holders 15 by bolts 18 via holding plates 17, and furthermore, the other ends of the holders 15 are eccentrically fixed to the roller supporting levers 14 using split clamps.

Meanwhile, each one end side of a first spring bearing member 20 and a guide rod 21 is rotatably connected to the other end side of each roller supporting lever 14, and each second spring bearing 22 is slidably engaged with the guide rod 14 on the other end side thereof. The second spring bearing member 22 is rotatably mounted on the frame 1, and a compression coil spring 23 is wound around the guide rod 21 between the first and second spring bearing member 20 and 22. Accordingly, a rotating force round each bearing 10 supplied to the roller supporting lever 14 by a biasing force of the compression coil spring 23 and the rotating force pushes the first and second form roller 13*b* and 13*c* against the plate cylinder 4.

Each rolling member supporting lever 25 is rotatably mounted on each bearing 10 of the first and second swing rollers 9*a* and 9*b*, and two rows of bearing rollers (cam followers) 27 are mounted on one end side of the rolling member supporting lever 25 by means of a pin 26. The inner bearing roller 27 and outer bearing roller 27 are brought into contact the cam surface 6*a* of the above described plate cylinder follow-up cam 6 and the cam surfaces 7*b* and 7*c* of the roller-lifting cam 7 as defined above, respectively.

The other end sides of the roller supporting lever 14 and rolling member supporting lever 25 are connected to each other through the intermediary of a screw rod 29 as a adjusting means using pins 28*a* and 28*b*.

The screw rod 29 is extended to the end surface of the frame via an universal joint 30, and a square rod portion 29*a* of the tip end thereof is slidably and axially inserted into a square hole 32*a* of a handle 32 connected to the frame 1 by a pin 31. The connection of the square rod portion 29*a* and square hole 32*a* allows the screw rod 29 to move forward and backward when the second and third form roller 13*b* and 13*c* are attached or detached by the roller-lifting cam 7.

Furthermore, as shown in FIG. 4, another roller supporting lever (the first lever) 35 is rotatably mounted on the bearing 10 of the first swing roller 9*a* as it adjoins the rolling member supporting lever 25, the first form roller 13*a* rotatably supported by the tip end of the roller supporting lever 35 via a holder 15A. Each bearing 16, for support the axial end of the first form roller 13*a*, is fixed to one end side of the holder 15A by bolts 18 via a holding plate 17, the other end side of the holder 15A is eccentrically fixed to the roller supporting lever 35 using a split clamp, and hence a contact pressure of the first form rollers 13*c* applied to the first swing rollers 9*c* is made adjustable by unclamping the split clamps followed by shifting the holders 15A.

As illustrated in FIG. 5, a rotational shaft 37, as it is not rotatable, connected to a rotary lever 36 is rotatably engaged with the holder 15A, the shaft axis of the rotational shaft 37 is deviated from that of the first form roller 13*a*. A plate cam 38 (cam follower) and bearing rollers 27 are mounted on an eccentric shaft 37*a* on the outer end side of the rotational shaft 37. The inner plate cam 38 and outer bearing roller 27 are brought into contact with the cam surface 6*a* of the plate cylinder follow-up cam 6 as mentioned above and the cam surface 7*a* of the roller-lifting cam 7 as mentioned likewise, respectively.

A pin 39, within which a female screw is formed, is engaged with the tip end portion of the rotational lever 36 rotatably engaged with the holder 15A. On the other hand, an adjusting screw 40, screwed into the pin 39, is rotataly mounted on the roller supporting lever 35 via a pin 41 engaged with the roller supporting lever 35.

Accordingly, when the adjusting screw 40 is rotated directly or using a screw driver 43 (refer to FIGS. 1 and 4) etc., the pin 39 moves forward or backward to the adjusting screw 40 so that the rotational lever 36 and rotational shaft 37 rotates in relation to the holder 15A. As a result, the shaft axis of the plate cam 38 mounted on the rotational shaft 37 moves on the circular arc around the shaft axis of the holder 15, and the shaft axis of the plate cam 38 is relatively shifted in relation to the shaft axis of the first form roller 13*a*. The position of the first form roller 13*a* in relation to the plate cylinder 4 is shifted into the radial direction of the plate cylinder 4 and thereby a nip pressure is able to be adjusted.

Furthermore, a roller attaching/detaching lever (the second lever) 45 is rotatably mounted on the bearing 10 of the first swing roller 9*a* as it adjoins the roller supporting lever 35, and the tip end of the roller attaching/detaching lever 45 and the tip end of an inner lever 47 fixed to the inner end of an attaching/detaching pin 46, penetrating rotatably the frame 1, are interconnected by a link 49 using pins 48 in respective connections.

A first spring bearing member 51 and one end side of a guide rod 52 each are rotatably connected to the tip end of an outer lever 50 fixedly formed on the outer end of the attaching/detaching pin 46, and the second spring bearing member 53 is slidably engaged with the guide rod 52 on the other end side thereof. The second spring bearing member 53 is rotatably mounted on the frame 1, and a compression coil spring 54 is wound around the guide rod 52 between the first spring bearing member 51 and the second spring bearing member 53. Accordingly, a rotating force around the attaching/detaching pin 46 acts on the inner lever 47 owing to a biasing force of the compression coil spring 54, and the roller attaching/detaching lever 45 is pushed as it is usually restricted by a stopper 55 against the side of the contact position of the first form roller 13*a* (refer to the solid lines in FIG. 1). On the other hand, when the inner lever 47 is rotated counterclockwise directly or using a spanner (refer to FIG. 1) etc. in FIG. 1, as shown in FIG. 6, the outer lever 50 and guide rod 52 are subjected to resilient reverse (over a dead point), thereby it is now pushed, as it is restricted by a stopper 57, against the side of the detachment position of the first form roller 13*a* (refer to the imaginary lines in FIG. 1).

A first spring bearing member 60 and one end side of a guide rod 61 are each rotatably connected to the tip end of the roller supporting lever 35, a second spring bearing member 62 and a guide rod 61 are each rotatably engaged with the guide rod 61 on the other end side thereof. The second spring member 62 is rotatably mounted on the other tip end of the roller attaching/detaching lever 45, and a compression coil spring 63 is wound around the guide rod 61 between the first spring bearing member 60 and the second spring bearing member 62. A collar 64 is fixed to the slidable end of the guide 61.

Accordingly, a rotational force round the bearing 10 acts on the roller supporting lever 35 owing to a biasing force of the compression coil spring 63, and hence the first form roller 13*a* is pushed against the plate cylinder 4 by the rotational force. When the roller attaching/detaching lever 45 is rotated toward the side of the detachment position of the first form roller 13*a* and switched over thereto, the roller supporting lever 35 is rotated in the same direction within the limit caused by the collar 64 as it is drawn by the guide rod 61, and thereby the first form roller 13*a* is largely retreated (absented) from the plate cylinder 4 (refer to the imaginary lines in FIGS. 1 and 4). The numerals 70 and 71 each denote ink rollers and an ink top, respectively.

As constituted above, while printing is not conducted, the roller-lifting cam 7 is driven by the driving means of the lever 8*a*, rod 8*b*, and attaching/detaching means (not illustrated) to be swingably moved upward. Thereby, the three bearing rollers 27 which contact the three cam surfaces 7*a*, 7*b* and 7*c* of the roller-lifting cam are shifted while resisting the biasing forces of the compression coil springs 29 and 63, together with the rolling member supporting lever 24 and roller attaching/detaching lever 45, as it is lifted from the plate cylinder 4. Hence, the first to third rollers 13*a* to 13*c* are separated from the printing roller 4 to take a non-contact form.

When a twist adjustment of the plate cylinder 4 is conducted by shifting either of the second right-and-left eccentric bearings, since the printing follow-up cam 6 mounted on the second eccentric bearing 3 moves together with the plate cylinder 4, the two bearing rollers 27 and the plate cam 38, which are pushed against the cam surface 6*a* of the printing follow-up cam 6, are also moved simultaneously. Accordingly, before and after the twist adjustment, the positional relation between the first to third form rollers 13*a* to 13*c* and the plate cylinder 4 is not altered and then the nip pressure remains unchanged.

In order that the plate cylinder 4 is dismounted in the embodiment, the roller attaching/detaching lever 45 is rotated toward the side of the detachment position, as defined by the stopper 57, of the first form roller 13*a* to be switched over thereto by rotating the inner lever 47 directly or using a spanner 56 (refer to FIG. 1) etc. counterclockwise to thereby subject the outer lever 50 and guide rod 53 to resilient reverse. According to the above, the roller supporting lever 35 is rotated in the same direction within the limit caused by the collar 64 as it is drawn by the guide rod 61, and consequently the first form roller 13*a* is largely retreated from the plate cylinder 4 so that a large space for taking out and removing the plate cylinder 4 is made.

Accordingly, even when a running position of the first form roller 13*a* is situated in such a position that it cannot be removed even though the plate cylinder 4 is dismounted, the plate cylinder 4 is able to be dismounted and removed by moving the first form roller 13*a* largely to the retreat position as described above without removing it. After the plate cylinder is replaced, the first form roller 13*a* can be returned precisely to the running position before the replacement of the plate cylinder by now rotating the inner lever 47 clockwise in FIG. 1, and hence any readjustment of a nip pressure is not required.

In the above embodiment, as a measure of retreating largely the form roller, it is operated using a spanner 56, however, it is possible to absent the roller by mounting a motor on a bolt portion (rotating operation portion) or conduct a rotating operation by directly employing an actuator such as a air cylinder, hydraulic cylinder, etc. via the lever.

The present invention is never limited to the above embodiments, needless to say, any various changes, modifications and alterations of the embodiments are possible as far as they depart from the spirit and scope of the invention.

According to an inking device for a printing machine of the present invention, the inking device is provided with a constitution wherein a form roller is enabled to move to a retreat position being apart greatly from a detachment position, besides a running position and the detachment position which are conventionally employed. Accordingly, the form roller can be to moved largely to the retreat position from a plate cylinder without removing the form roller and while keeping a set condition of a nip pressure etc. to make it easier to remove a plate cylinder.

The inking device comprises the first lever supporting a form roller, the second lever supported to be linked with a link mechanism mounted on a machine frame, and spring members each wound round these levers to push the form roller against the plate cylinder, consequently, a mechanism for attaching/detaching a form roller by the second lever is easily parted from another mechanism for acting on the form roller etc. by the first lever without causing any trouble in both the mechanisms, and consequently the reliability of the unit is raised.

What is claimed is:

1. A plate cylinder replacing mechanism for a printing machine, the printing machine having a plate cylinder supported by a machine frame, and a form roller provided within the machine frame, comprising:

a lever pivotally supported on the machine frame and adapted to rotatably support the form roller, said lever adapted to selectively move the form roller among an attachment position where the form roller contacts the plate cylinder, a detachment position where the form roller is separated from the plate cylinder, and a retreat position where the form roller is separated from the plate cylinder, as much as a predetermined distance from the detachment position, such that in said retreat position, removal and installation of the plate cylinder from the machine frame are not impeded, the form roller moving among the attachment position, the detachment position and the retreat position around a pivot center of the lever.

2. The plate cylinder replacing mechanism according to claim 1, further comprising:

a link mechanism connected to said lever and supported by the machine frame; and an operating portion connected to said link mechanism, such that the form roller moves between said running position and said retreat position by an operation of said operating portion via said link mechanism.

3. The plate cylinder replacing mechanism according to claim 2, wherein said lever includes, a first lever for rotatably supporting the form roller, a second lever supported coaxially with said first lever so as to be linked with said link mechanism, and a spring member, provided between said first lever and said second lever, for urging the form roller against the plate cylinder through via a guide rod provided between said first lever and said second lever.

4. The plate cylinder replacing mechanism according to claim 3, further comprising:

an oscillating roller in contact with the form roller, wherein said first lever and said second lever are provided adjacently with respect to one another and supported coaxially by a rotational shaft of said oscillating roller.

5. The plate cylinder replacing mechanism according to claim 3, wherein the form roller is supported by said first lever via a holder, and one end portion of the holder is eccentrically supported, with respect to a rotational axis of the form roller, by said first lever.

6. The plate cylinder replacing mechanism according to claim 2, further comprising:

a plate cylinder follow-up cam attached to a member supporting the plate cylinder, said follow-up cam maintaining a position relative to the plate cylinder even after an adjustment of the rotational axis of the plate cylinder; and a first cam follower in contact with said plate cylinder follow-up cam, wherein said cam follower is supported by said lever.

7. The plate cylinder replacing mechanism according to claim 6, wherein said cam follower is movably supported by said lever and additionally including means for adjusting the position of the cam follower.

8. The plate cylinder replacing mechanism according to claim 6, further comprising:

a roller-lifting cam that moves between a first position and a second position;

means for selectively moving said roller lifting cam between said first and second positions; and another cam follower supported by said lever and adapted to make contact with said roller lifting cam such that the form roller makes contact with the plate cylinder when said roller-lifting cam is in the first position and moves the form roller away from the plate cylinder when said roller-lifting cam is in the second position.

9. A plate cylinder replacing mechanism for a printing machine, the printing machine having a plate cylinder supported by a machine frame, and a form roller provided within the machine frame, comprising:

a lever pivotally supported on the machine frame and adapted to rotatably support the form roller, said lever being adapted to selectively move the form roller between an attachment position where the form roller contacts the plate cylinder, and a retreat position where the form roller is separated from the plate cylinder, such that in said retreat position, removal and installation of the plate cylinder from the machine frame are not impeded, the form roller moving among the attachment position, the detachment position, and the retreat position around a pivot center of the lever; and a linking mechanism adapted to move said lever between said attachment position and said retreat position from an outside of the machine frame.

10. A plate cylinder replacing mechanism for a printing machine, the printing machine having a plate cylinder supported by a machine frame, and a form roller provided within the machine frame, comprising:

a lever assembly adapted to rotatably support the form roller, said lever assembly adapted to selectively move the form roller among an attachment position where the form roller contacts the plate cylinder, a detachment position where the form roller is separated from the plate cylinder, and a retreat position where the form roller is separated from the plate cylinder, as much as a predetermined distance from the detachment position, such that in said retreat position, removal and installation of the plate cylinder from the machine frame are not impeded;

a link mechanism connected to said lever assembly and supported by the machine frame;

an operating member connected to said link mechanism, such that the form roller moves between said attachment position and said retreat position by an operation of said operating member by means of said link mechanism; and, wherein said lever assembly includes, a first lever for rotatably supporting the form roller, a second lever supported coaxially with said first lever so as to be linked with said link mechanism, and a spring member, provided between said first lever and said second lever, for urging the form roller against the plate cylinder through via a guide rod provided between said first lever and said second lever.

11. A plate cylinder replacing mechanism for a printing machine, the printing machine having a plate cylinder supported by a machine frame, and a form roller provided within the machine frame, comprising:

a lever assembly adapted to rotatably support the form roller, said lever assembly adapted to selectively move the form roller among an attachment position where the form roller contacts the plate cylinder, a detachment position where the form roller is separated from the plate cylinder, and a retreat position where the form roller is separated from the plate cylinder, as much as a predetermined distance from the detachment position, such that in said retreat position, removal and installation of the plate cylinder from the machine frame are not impeded;

a link mechanism connected to said lever assembly and supported by the machine frame;

an operating member connected to said link mechanism, such that the form roller moves between said attachment position and said retreat position by an operation of said operating member by means of said link mechanism;

a plate cylinder follow-up cam attached to a member supporting the plate cylinder, said follow-up cam maintaining a position relative to the plate cylinder even after an adjustment of the rotational axis of the plate cylinder; and, a cam follower in contact with said plate cylinder follow-up cam, and wherein said cam follower is supported by said lever assembly.

12. A plate cylinder replacing mechanism for a printing machine, the printing machine having a plate cylinder supported by a machine frame, and a form roller provided within the machine frame, comprising:

a lever assembly adapted to rotatably support the form roller, said lever assembly being adapted to selectively move the form roller between an attachment position where the form roller contacts the plate cylinder, and a retreat position where the form roller is separated from the plate cylinder, such that in said retreat position, removal and installation of the plate cylinder from the machine frame are not impeded;

a link mechanism connected to said lever assembly and supported by the machine frame;

an operating portion connected to said link mechanism, such that the form roller moves between said attachment position and said retreat position by an operation of said operating portion via said link mechanism; and, said lever assembly including, a first lever for rotatably supporting the form roller, a second lever supported coaxially with said first lever so as to be linked with said link mechanism, and a spring member, provided between said first lever and said second lever, for urging the form roller against the plate cylinder through via a guide rod provided between said first lever and said second lever;

a plate cylinder follow-up cam attached to a member supporting the plate cylinder, said follow-up cam maintaining a position relative to the plate cylinder even after an adjustment of the rotational axis of the plate cylinder; and a cam follower in contact with said plate cylinder follow-up cam.

13. The plate cylinder in accordance with claim 12, further comprising an oscillating roller in contact with the form roller, and wherein said first lever and said second lever are provided adjacently with respect to one another and supported coaxially by a rotational shaft of said oscillating roller.

14. The plate cylinder in accordance with claim 12, wherein the form roller is supported by said first lever via a holder, and one end portion of the holder is eccentrically supported with respect to a rotational axis of the form roller by said first lever.

15. The plate cylinder in accordance with claim 12, wherein said cam follower is movably supported by said lever assembly and provided with an adjusting means for adjusting a position of the cam follower.

16. The plate cylinder in accordance with claim 12, further comprising:

a roller-lifting cam that moves between a first position and a second position;

moving means for selectively moving said roller lifting cam between said first and second positions; and a second cam follower supported by said lever and adapted to make contact with said roller lifting cam such that the form roller makes contact with the plate cylinder when said roller-lifting cam is in the first position and moves the form roller away from the plate cylinder when said roller-lifting cam is in the second position.

* * * * *